US008510973B2

(12) United States Patent
Bachmann et al.

(10) Patent No.: US 8,510,973 B2
(45) Date of Patent: Aug. 20, 2013

(54) FOOTWEAR WITH RETRACTABLE SPIKES

(75) Inventors: Darrell Bachmann, Penticton (CA); Michael H. Boudreau, Salmon Arm (CA); Carl S. Flatman, Salmon Arm (CA); Nicolas B. Sunder, Salmon Arm (CA)

(73) Assignee: Kickspike Enterprises Ltd., Vancouver (CA)

( * ) Notice: Subject to any disclaimer, the term of this patent is extended or adjusted under 35 U.S.C. 154(b) by 520 days.

(21) Appl. No.: 12/734,550

(22) PCT Filed: Nov. 7, 2007

(86) PCT No.: PCT/CA2007/001990

§ 371 (c)(1),
(2), (4) Date: May 7, 2010

(87) PCT Pub. No.: WO2009/059389

PCT Pub. Date: May 14, 2009

(65) Prior Publication Data

US 2010/0229428 A1 Sep. 16, 2010

(51) Int. Cl.
*A43C 15/14* (2006.01)

(52) U.S. Cl.
USPC ..... 36/61; 36/127

(58) Field of Classification Search
USPC ..... 36/61, 127, 134
See application file for complete search history.

(56) References Cited

U.S. PATENT DOCUMENTS

| | | | | |
|---|---|---|---|---|
| 3,716,931 | A | 2/1973 | Loudermilk | |
| 3,793,751 | A | 2/1974 | Gordos | |
| 4,375,729 | A | 3/1983 | Buchanen, III | |
| 4,821,434 | A | 4/1989 | Chein | |
| 5,269,080 | A * | 12/1993 | Davis | 36/134 |
| 5,299,369 | A | 4/1994 | Goldman | |
| 5,337,494 | A | 8/1994 | Ricker | |
| 5,497,565 | A | 3/1996 | Balgin | |
| 5,732,482 | A | 3/1998 | Remington et al. | |
| 5,815,951 | A | 10/1998 | Jordan | |
| 5,836,092 | A | 11/1998 | Yarnell | |
| 5,870,838 | A | 2/1999 | Khayat | |
| 5,956,870 | A | 9/1999 | Grossman et al. | |
| 6,058,627 | A | 5/2000 | Violette et al. | |
| 6,256,907 | B1 | 7/2001 | Jordan et al. | |
| 6,389,714 | B1 | 5/2002 | Mack | |
| 7,926,205 | B2 * | 4/2011 | Åmark | 36/61 |
| 2006/0021254 | A1 * | 2/2006 | Jones | 36/61 |

FOREIGN PATENT DOCUMENTS

| | | |
|---|---|---|
| CA | 02226532 | 2/1999 |
| CA | 2345425 | 10/2002 |
| CA | 2510291 | 1/2006 |
| WO | WO2009/059389 | 5/2009 |
| WO | WO2009/110822 | 9/2009 |

* cited by examiner

*Primary Examiner* — Ted Kavanaugh
(74) *Attorney, Agent, or Firm* — Antony C. Edwards

(57) ABSTRACT

A shoe and an apparatus for selectively extending spikes from the bottom of a shoe. The shoe has a sole having a longitudinal direction a plurality of spike apertures. The apparatus comprises a plurality of spike assemblies, each being locatable within one of the spike apertures an elongate member extending substantially parallel to the longitudinal direction of the shoe and a cyclically alternating positioner for moving the elongate member between the first and second positions. The positioner including an actuating button. Depressing the actuating button a first time causes the positioner to move the elongate member to a first position whereat the spikes are extended from the sole. Depressing the actuating button a second time causes the positioner to move the elongate member to the second position whereat the spikes are retracted into the sole.

9 Claims, 9 Drawing Sheets

FOOTWEAR WITH RETRACTABLE SPIKES

BACKGROUND OF THE INVENTION

1. Field of Invention

The present invention relates to footwear in general and to a method and apparatus for providing footwear with selectively extendable spikes in particular.

2. Description of Related Art

Traction is necessary for proper performance in many sports. For example, in the sport of golf, proper traction is required during full swing shots such as the tee shot and many fairway shots. Due to the grass covered surfaces on which golf is played, however, proper traction may be difficult. It is well known that the addition of spikes to the bottom of footwear for golf shoes helps to provide the necessary traction on such a surface. Such spikes were traditionally made of sharpened elongate metal projections.

Traditional metal spikes, however, suffered from the disadvantage of being damaging to some surfaces. In particular, the putting greens surfaces which have a significantly shorter grass length have been found to be damaged by metal spikes. Such metal spikes have been known to cause significant damage to putting greens by leaving holes and ridges in the ground as well as damaging the more delicate putting green grasses.

One solution to the above disadvantages of metal spikes has been to replace the traditional metal spikes with a spike insert comprising a plurality of plastic or rubber protrusions which are also known as the "soft spike". Soft spikes have resulted in less damage to the putting greens surfaces. Accordingly, many golf courses have enacted rules prohibiting traditional metal spikes in favor of soft spikes. However, soft spikes have also reduced the traction provided to the golfer during full swing shots such as the tee shot. Therefore, while most recreational golfers now use soft spikes, many professional players continue to use metal spikes. The use of metal spikes for professional golf tournaments results in a significant amount of damage to the putting greens which is both costly to repair as well as obstructive to the play of later players.

Soft spikes have also not completely eliminated the damage occurring to golf course greens. As developers of soft spikes have attempted to increase the traction provided by soft spikes, the amount of damage these spikes inflicts on putting greens increases. In particular, it is known that metal spikes and newer designs of soft spikes results in damage to the structure of the grass making these grasses more susceptible to disease and other difficulties. Putting greens therefore require more fungicides, pesticides and water to ameliorate the damage caused to the grass from metal and soft spikes.

Previous attempts have been made to provide shoes with selectively extendable and retractable spikes. Examples of such shoes may be found in U.S. Pat. No. 4,821,434 to Chein, U.S. Pat. No. 6,058,627 to Violette et al., and U.S. Pat. No. 4,375,729 to Buchanen, III. However, such devices have not been suitable for use in a golf shoe as there are separated controls to extend or retract the spikes. Several of these controls are located in the toe of the sole where they may be prone to actuation during the follow-through of a golf swing.

Other attempts have required the user to activate the extension or retraction of the spikes from the sole of the shoe by manipulating a tab lever, screw or other device on the sole of the shoe itself. Examples of such devices may be found at U.S. Pat. No. 5,836,092 to Yarnell, U.S. Pat. No. 5,497,565 to Balgin, U.S. Pat. No. 6,389,714 to Mack, U.S. Pat. No. 5,956,870 to Grossman et al., U.S. Pat. No. 6,256,907 to Jordan et al., U.S. Pat. No. 5,732,482 to Remington et al., U.S. Pat. No. 5,870,838 to Khayat and U.S. Pat. No. 5,269,080 to Davis. Such devices have not been acceptable due to the need to bend down to extend or retract the spikes which may be difficult for some users and time consuming.

SUMMARY OF THE INVENTION

According to a first embodiment of the present invention there is disclosed an apparatus for selectively extending spikes from the bottom of a footwear article. The footwear article has a sole which has a longitudinal direction and a plurality of spike apertures. The apparatus comprises a plurality of spike assemblies, each locatable within one of the spike apertures and an elongate member extendable substantially parallel to the longitudinal direction of the footwear article and being movable between first and second positions. The elongate member is operable to extend the spikes from the footwear article at the first position and to retract the spikes within the footwear article at the second position. The apparatus further comprises a cyclically alternating positioner for moving the elongate member between the first and second positions wherein the positioner has an actuating button. Depressing the actuating button a first time causes the positioner to move the elongate member to the first position. Depressing the actuating button a second time causes the positioner to move the elongate member to the second position.

According to a first embodiment of the present invention there is disclosed a shoe having an upper and a sole portion and a longitudinal direction. The sole having a plurality of spike apertures and a selective spike extending assembly for extending a plurality of spikes from the sole through the plurality of spike apertures. The spike extending assembly comprises a plurality of spike assemblies, each being locatable within one of the spike apertures and an elongate member extendable substantially parallel to the longitudinal member of the shoe and being movable between first and second positions. The elongate member is operable to extend the spikes from the shoe at the first position and to retract the spikes within the shoe at the second position. The spike extending assembly further comprises a cyclically alternating positioner for extending the member between the first and second positions wherein the positioner has an actuating button. Depressing the actuating button a first time causes the positioner to move the elongate member to the first position. Depressing the actuating button a second time causes the positioner to move the elongate member to the second position.

The actuating button may be a single button. The actuating button may comprise a plunger button acting against a return biasing spring. The plunger button may be cantilevered from a heal portion of the sole in a substantially horizontal plane.

A portion of the sole may cover the actuating button. The actuating button may be contained within the sole. The actuating button may project from the sole.

The apparatus may further comprise at least one rod extending transversely across the sole for transmitting the movement of the elongate member to the spike assemblies. The at least one rod may be supported within a slot in the elongate member, wherein the slot may be orthogonal to the elongate member and the at least one rod. The spike assemblies may further comprise a sleeve receivable within the apertures, a spike slidably supported within the sleeve, a first link extending from a bottom portion of the sleeve to the at least one rod and a second link extending from a top portion of the spike to the at least one rod.

The at least one rod may be secured to the elongate member. The spike assemblies may further comprise a sleeve receivable within the apertures, a spike slidably supported within the sleeve and a wedge secured to the spike wherein a portion of the at least one rod engages the wedge. The rod causes the spike to be extended as the elongate member is moved to the first position.

The rod may be pivotally secured to the sole and include a pinion gear engagable with a rack gear of the elongate member. The rod further includes a cam corresponding to each of the plurality of spike assemblies for extending the spikes. The spike assemblies may further include a sleeve receivable within the apertures and a spike slidably supported within the sleeve wherein the cams engage a top portion of the spikes.

BRIEF DESCRIPTION OF THE DRAWINGS

In drawings which illustrate embodiments of the invention wherein similar characters of reference denote corresponding parts in each view.

DETAILED DESCRIPTION

Figure 1:
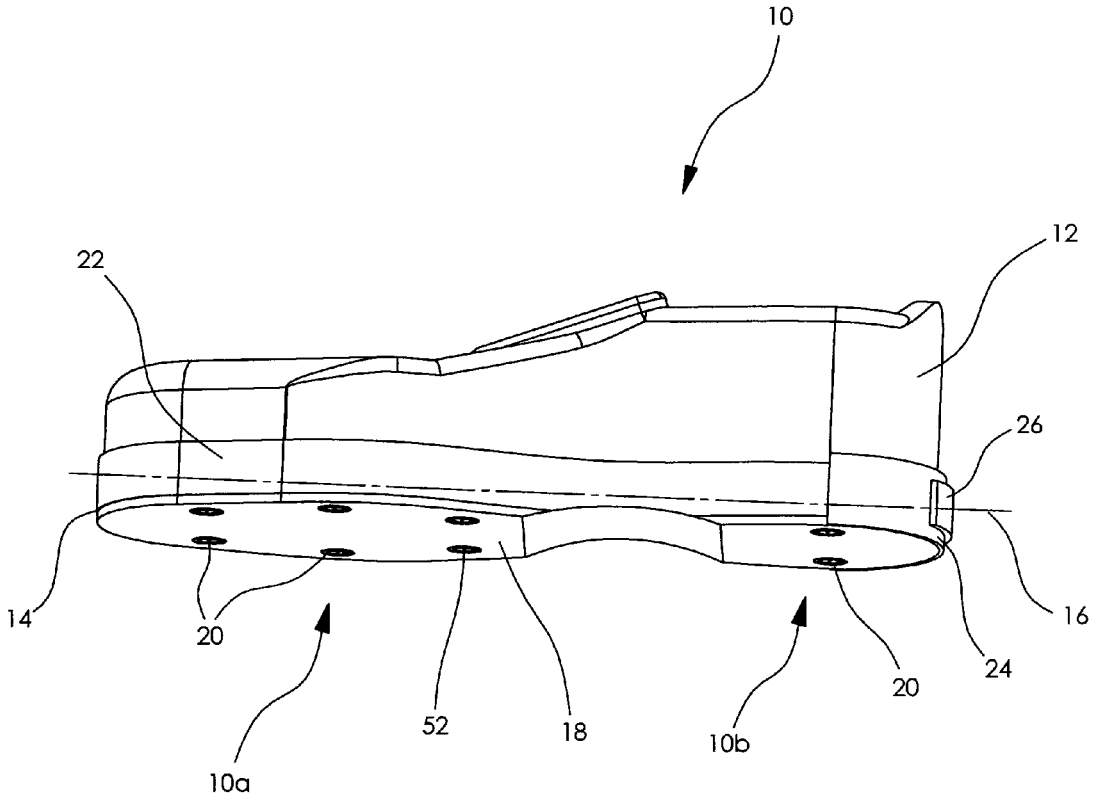
FIG. 1 is a perspective view of a footwear article having extendable spikes.

Referring to FIG. 1, a footwear article, or shoe having a retractable spikes according to a first embodiment of the present invention is shown generally at 10. The shoe 10 includes an upper portion 12, a sole 14 and has a longitudinal direction 16.

The sole 14 includes a bottom surface 18 and has a plurality of spike apertures 20 located therein for projecting spikes 52 therethrough. The sole 14 is bound by a peripheral edge surface 22 and includes a rearmost portion 24. The rearmost portion 24 of the sole 14 includes an actuating button 26 for selectively extending or retracting the spikes 52.

Figure 2:
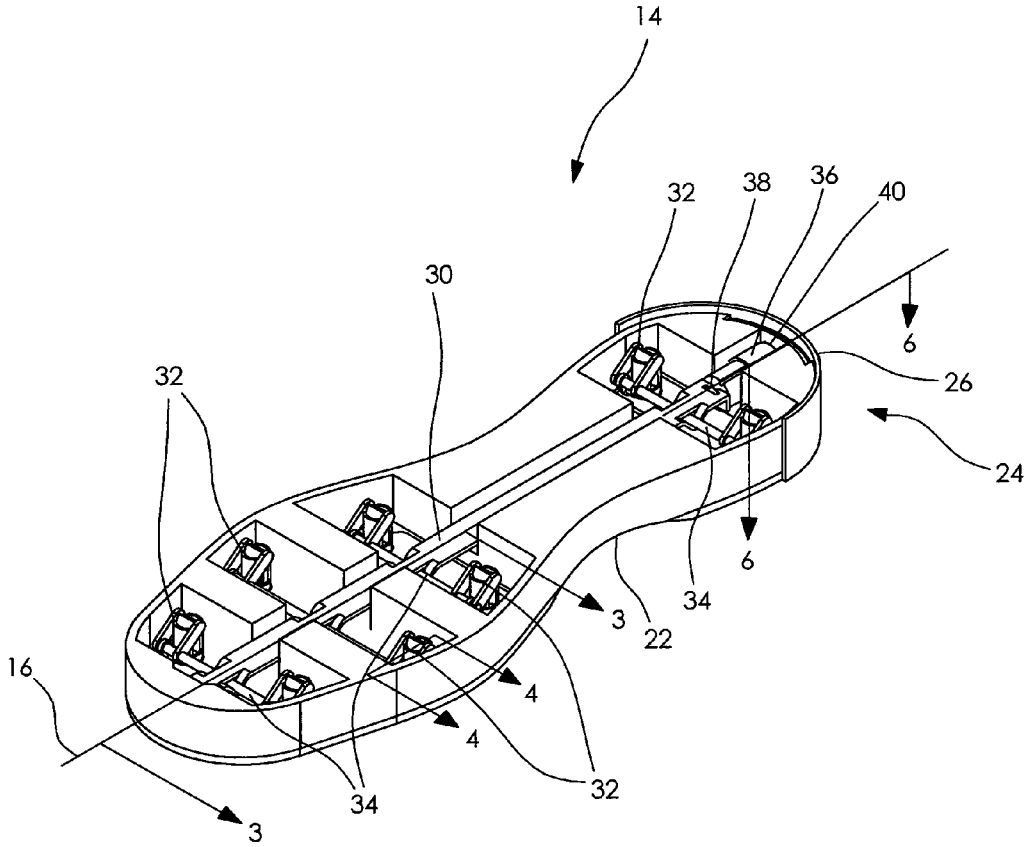
FIG. 2 is a perspective view of the sole of the footwear article of FIG. 1 with the footwear article removed.

Turning now to FIG. 2, a perspective view of the sole 14 of the shoe 10 is shown with the upper portion 12 of the shoe removed. The sole 14 includes an elongate member 30 extending substantially parallel to the longitudinal direction 16 of the shoe 10. Within the sole 14, at a location corresponding to each of the spike apertures 20, is a spike assembly 32. A plurality of transverse rods 34 extend transverse to the elongate member 30 between the elongate member and the spike assemblies 32.

A positioner 36 having opposite first and second ends 38 and 40 respectively is mounted in the rear of the sole 14. Positioner 36 is operably connected to the elongate member 30 at first end 38 adjacent to the rearmost portion 24 of the sole 14. The positioner 36 includes the actuating button 26 at second end 40. The positioner 36 is adapted to cyclically and alternately move the elongate member 30 so as to reciprocate between first and second positions along the longitudinal direction 16 of the shoe 10 in response to corresponding depressions of the actuating button 26. At the first position of the elongate member 30, the spikes 52 are extended from the sole 14 of the shoe 10 as further described below. At the second position of the elongate member 30, the spikes 52 are retracted into the sole 14 of the shoe 10. As illustrated and described below, the first position is oriented forward within the shoe 10 relative to the second position. It will be appreciated, however, that the first position may be rearward within the shoe 10 of the second position with corresponding alterations to the spike assemblies 32. For greater certainty, a first actuation or depression of the actuating button 26 by a user will cause the positioner 36 to move the elongate member 30 to the first position. Thereafter, a second actuation or depression of the actuation button 26 by a user will cause the positioner to retract the elongate member 30 to the second position. It will be appreciated that subsequent actuations or depressions of the actuating button will cause corresponding cyclical reciprocating motions of the elongate member.

The elongate member 30 is constructed of a material selected to have sufficient compressive strength permitting the elongate member to adequately actuate the spike assemblies 32 as will be appreciated from the description below. In addition, the elongate member 30 may be constructed of a material selected to be flexible about a direction transverse to the longitudinal direction of the shoe 10 so as to permit bending of the sole 14 as the wearer walks. Non limiting examples of such material may include thin sheets of steel, aluminium, or certain types of plastics, such as for example polyethylene, polyvinyl chloride, polypropylene and polyurethane.

The positioner 36 may be of a conventional type, such as, for example in accordance with designs found in retractable pens or the like as are known. It will also be appreciated that other cyclical alternating mechanisms will also be useful. The actuating button 26 may be depressed or actuated by a user or wearer of the shoe by depressing the actuating button 26 with a finger or thumb. Alternately the user may impact or pressing the actuating button 26 against another shoe or object by manipulation of the shoe 10.

As illustrated in FIG. 2, the shoe may include eight spike apertures 20 arranged in longitudinally spaced apart transverse pairs symmetrically disposed on either lateral side of and along elongate member 30 such that a single rod 34 extends between each pair of apertures. As illustrated, the shoe 10 may include three pairs of spike assemblies in a forefoot 10*a* of the shoe and a single pair in the heel 10*b* of the shoe. It will be appreciated however that other arrangements of spike apertures 20 and spike assemblies 32 may be useful as well. By way of non-limiting example, the shoe 10 may include spike apertures 20 and spike assemblies 32 that are not arranged in pairs and therefore a single rod 34 may be used for actuating each spike assembly. In addition fewer or more spike assemblies 32 and spike assembly pairs may also be included within the heel 10*a* or forefoot 10*b* in accordance with the present description.

Figure 3A:
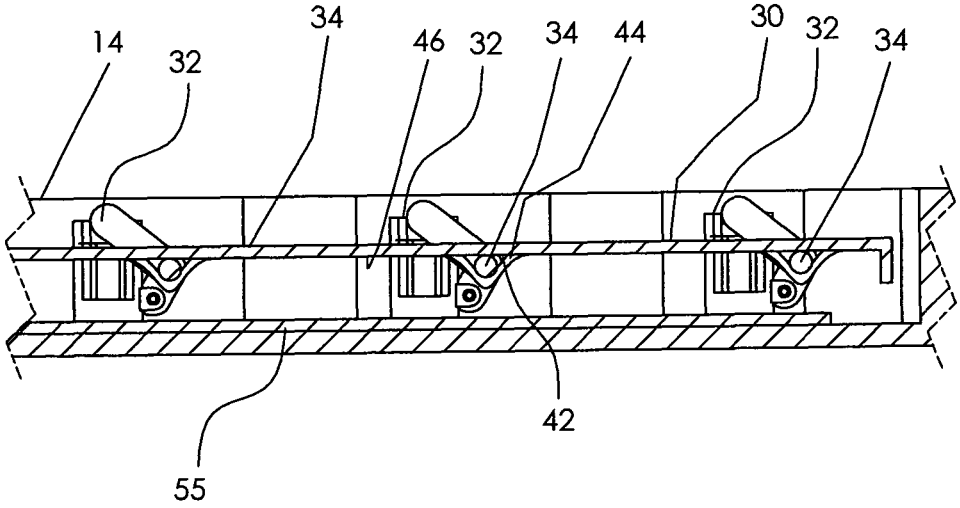
FIGS. 3*a-b* are cross sectional views of the footwear article of FIG. 2 as taken along the line 3-3.
Figure 3B:
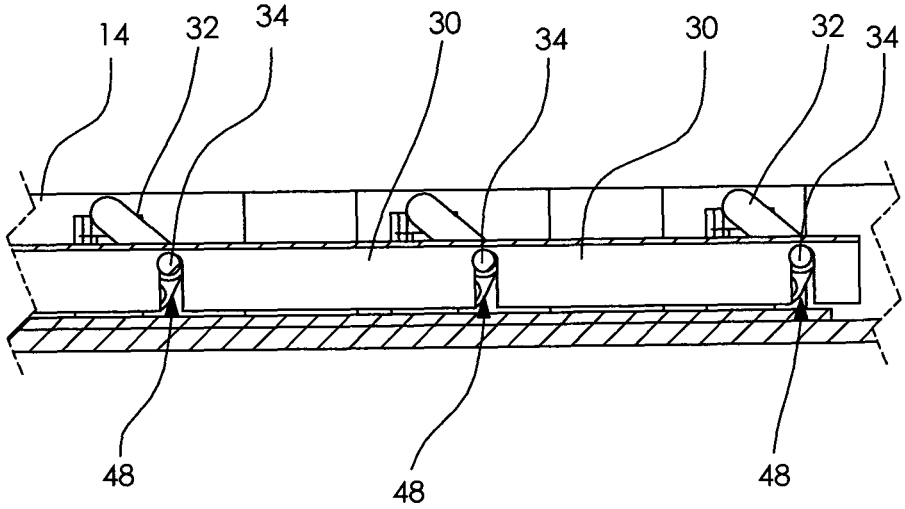

FIGS. 3*a* and 3*b* illustrate two alternative embodiments by way of example of a cross-sectional view of the sole 14 of the shoe 10 is illustrated along the line 3-3 of FIG. 2. FIG. 3*a* illustrates the elongate member 30 along a cross section that includes three transverse rods 34. At each of these locations, the elongate member 30 includes an aperture 42 lying in a plane which is oriented orthogonal to both the elongate member 30 and the rods 34 so as to accept rods 34 journalled therethrough. As illustrated in FIG. 3*a*, the apertures 42 may be formed by deforming the side portions 44 of the elongate member 30 into a u-shape below the remainder of the elongate member. The rods 34 may therefore be contained between the u-shaped side portions 44 and the underside 46 of the remainder of the elongate member 30.

The rods 34 and the elongate member 30 may therefore be freely movable in a vertical direction within the sole 14 of the shoe 10. The vertical movement of the elongate member 30 may be accommodated by a vertically slidable connection between the elongate member 30 and the positioner 36 according to known techniques.

In the alternative embodiment of FIG. 3*b*, the elongate member may include one or more slots 48 which serve to receive rods 34 therethrough instead of apertures 42. According to this embodiment, the elongate member 30 is not movable in a vertical direction but only in a horizontal direction. Any required vertical movement of the rods 34 may be permitted relative to the elongate member by the slots 48.

Figure 4:
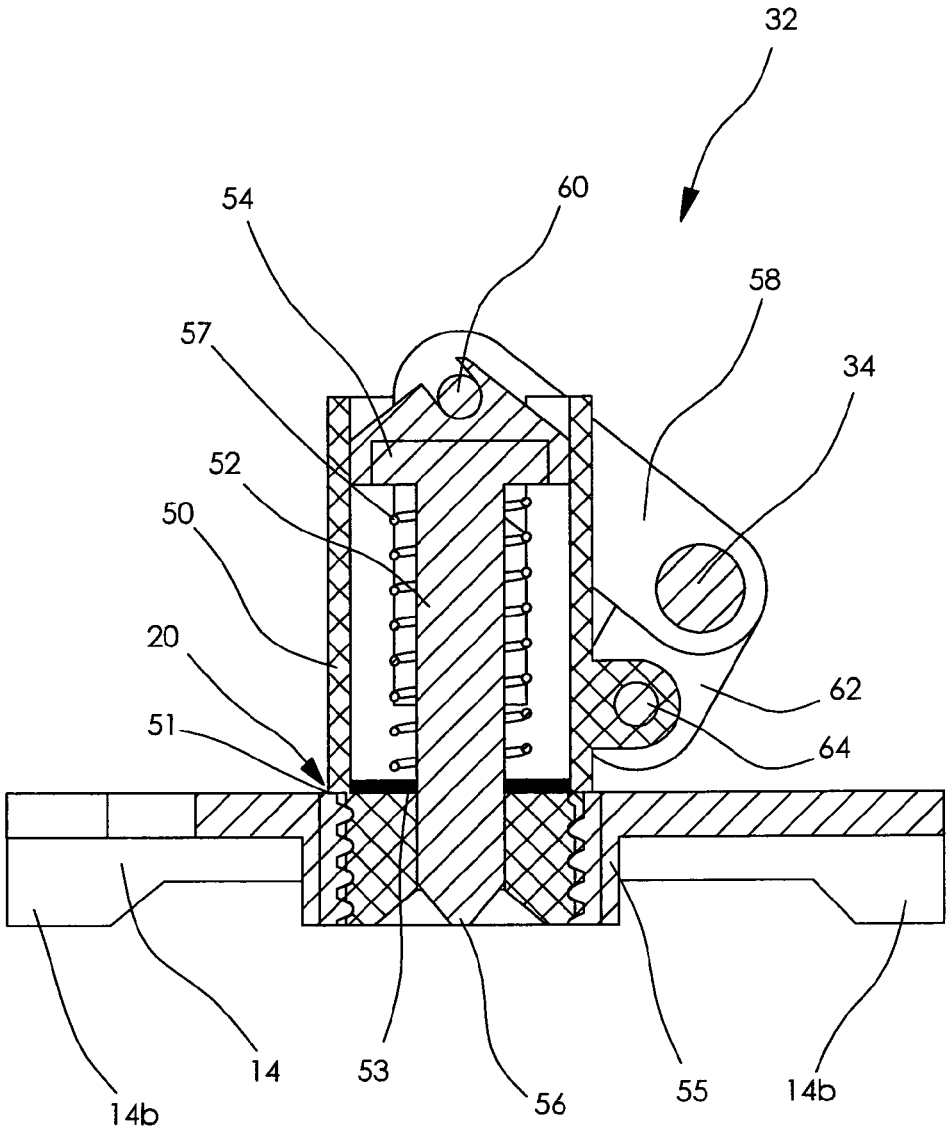
FIG. 4 is a cross sectional view of one spike assembly in the footwear article of FIG. 2 as taken along the line 4-4 with the spike in a retracted position.
Figure 5:
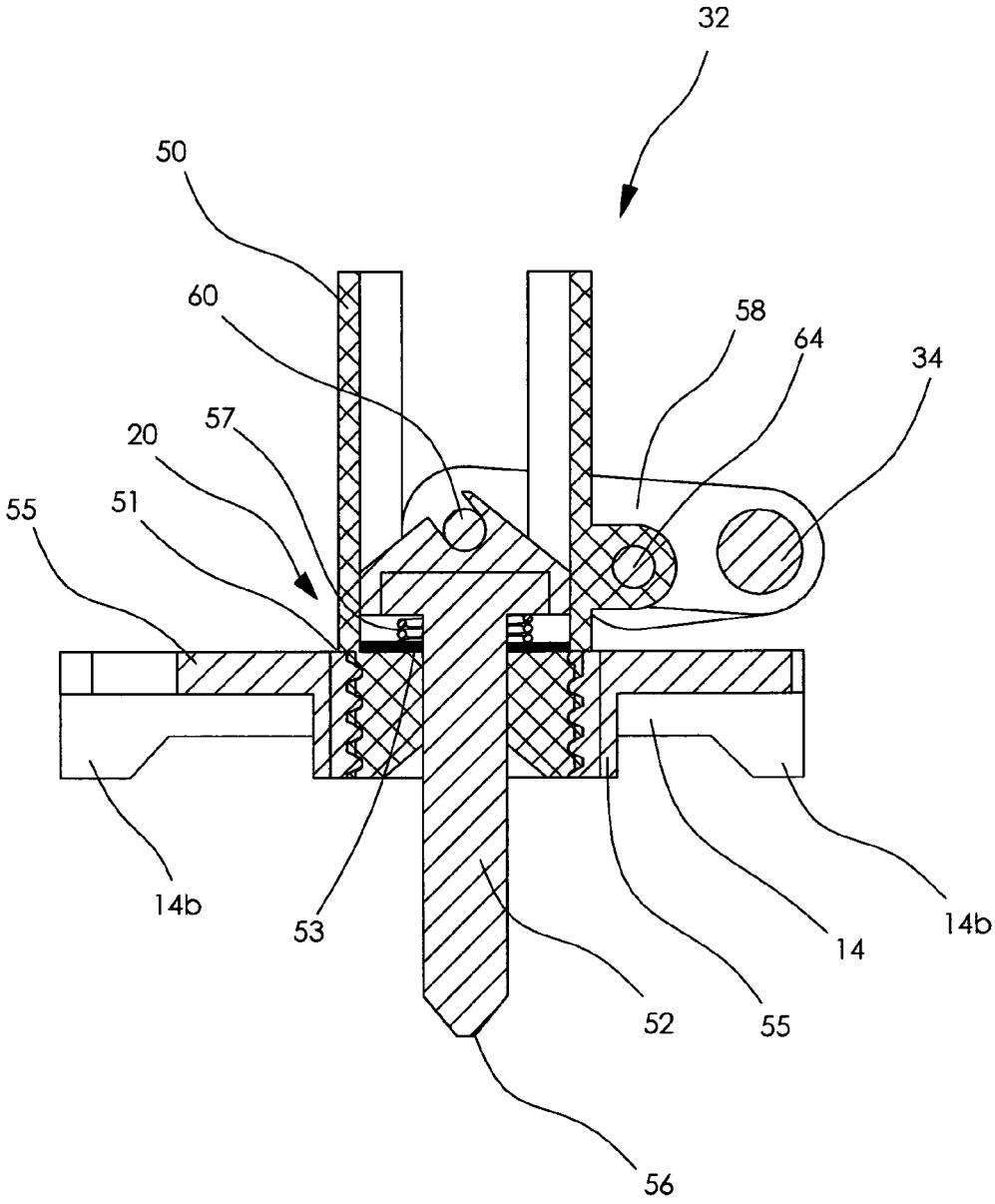
FIG. 5 is a cross sectional view of one spike assembly in the footwear article of FIG. 2 as taken along the line 4-4 with the spike in an extended position.

FIGS. 4 and 5 illustrate cross sectional views of a spike assembly 32 showing spikes partially retraced and fully extended respectively. Each spike assembly includes a sleeve 50 having a bottom portion 51 which is adapted to be fixedly received or otherwise mounted within a spike apertures 20. Each sleeve 50 slidably supports a spike 52 therein. The spike 52 has a top portion and a sharpened bottom portion 54 and 56, respectively. Each spike is actuated by a linkage of links 58 and 62. First link 58 extends between the top portion 56 of the spike 52 and the transverse rod 34. Second link 62 extends between the bottom portion 51 of the sleeve 50 and the transverse rod 34. The first link 58 is pivotally connected to the spike at first pivot 60. The second link is pivotally connected to the sleeve at second pivot 64 adjacent bottom portion 51. Both of the first and second link 58 and 62 are pivotally connected to the transverse rod 34.

As illustrated, the sole may include at least one securing plate 55 within the bottom portion of the sole for threadably receiving the sleeves 50. The securing plates 55 may be formed of a single member locatable within the forefoot 10*a* of the shoe and a single member locatable within the heel 10*b* of the shoe 10. Optionally, each spike aperture 20 may include a separate securing plate 55 or pairs of spike apertures may share a securing plate. The securing plate 55 may be constructed of a metal such as, for example, steel, stainless steel, aluminium or plastic selected to have a high pull out strength of the sleeves 50 to resist the pulling out from sole 14. The spike assembly 32 may also include seals 53 for sealing between the spike 52 and sleeve 50 as well as a biasing spike 57 for biasing the spike to a retracted position as illustrated in FIG. 4.

As illustrated in FIG. 4, the spike assembly 32 is at a retracted position wherein the bottom portion 56 of the spike 52 is retracted into the sole 14 of the shoe 10 such that either only a small portion or none of the spike extends from the sole. It will be appreciated that for some uses, the spike 52 may extend from the sole 14 itself so long as the spike 52 does not extend pas the traction protrusions 14*b* of the sole. For other uses, the spikes may extend farther or less than the distance from the sole of such traction protrusions 14*b*.

As illustrated in FIG. 5, the spike assembly 32 is at an extended position wherein the spike 52 extends significantly from the bottom of the sole 14. In the extended position, the transverse rod 34 has been moved away from the spike assembly in a horizontal direction generally indicated at 66 so as to cause the first and second links 58 and 62 to extend the spike 52 within the sleeve 50. It will be appreciated that a corresponding vertical movement of the rod 34 will also result from the movement of the first and second link 58 and 62. The corresponding vertical movement of the rod may be accommodated by the elongate member 30 as described above. Springs or other suitable means may also be incorporated between the spikes 52 and the sleeves 50 to urge the spikes into their retracted positions when the elongate member 30 is in its second position as described above.

Figure 6A:
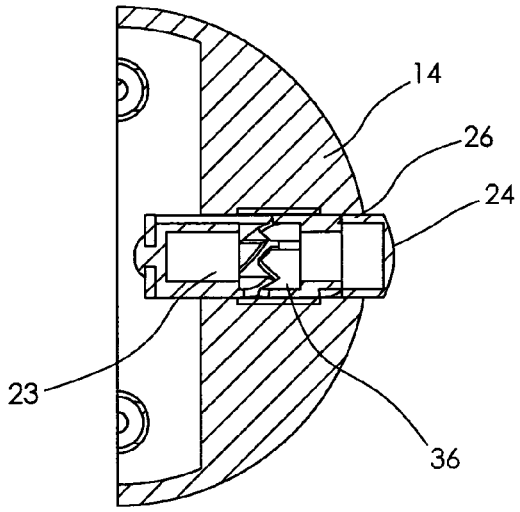
FIGS. 6*a-c* are cross sectional views of the actuating button of the footwear article of FIG. 2.
Figure 6B:
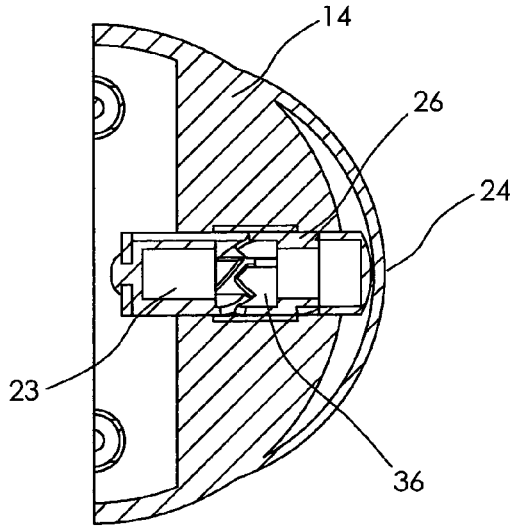
Figure 6C:
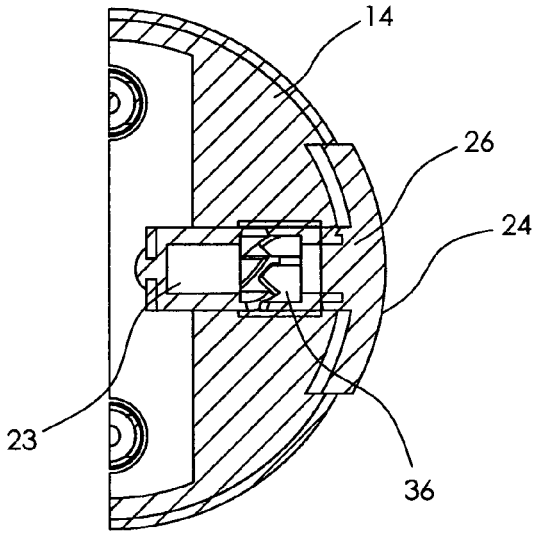

Turning now to the alternative embodiments of FIGS. 6*a-c*, a cross sectional view of the actuating button 26 within the sole 14 of the shoe is illustrated. The positioner is contained within a cavity 23 in the sole 14 of the shoe 10. The cavity 23 of the sole 14 may be filled with a gel or other suitable material so as to prevent the introduction of water or other materials into the sole 14 of the shoe. The gel may also assist in the cushioning of the provided to the wearer of the shoe 10. As shown in FIG. 6*a*, the actuating button 26 may extend through the rearmost portion 24 of the peripheral edge 22 of the sole 14. The rearmost portion 24 may therefore include a bore 25 therethrough for passing the actuating button 26. It will be appreciated that sealing between the bore 25 and the actuating button will be necessary to prevent the introduction of water, dirt and the like into the cavity 23 and the positioner 36. As illustrated in FIG. 6*c*, the actuating button 26 may also include a flanged or flared head portion extending through the rearmost portion 24. Thus, as illustrated the plunger button 26 is cantilevered from the heal portion of the sole 14 in a substantially horizontal plane relative thereto.

In the alternative embodiment of FIG. 6*b*, the rearmost portion 24 of the sole 14 may include a thin membrane extending over the actuating button 26 such that the actuating button 26 is contained within cavity 23 with the positioner 36. It will be appreciated that the membrane of the rearmost portion may follow the typical curvature of the sole 14 as illustrated in FIG. 6*b* or may optionally be bowed outward from the sole 14. As illustrated in FIGS. 6*a-c*, the actuating button 26 is a single button. It will be appreciated that in many embodiments the actuating button is a plunger button acting against a return biasing spring.

Figure 7:
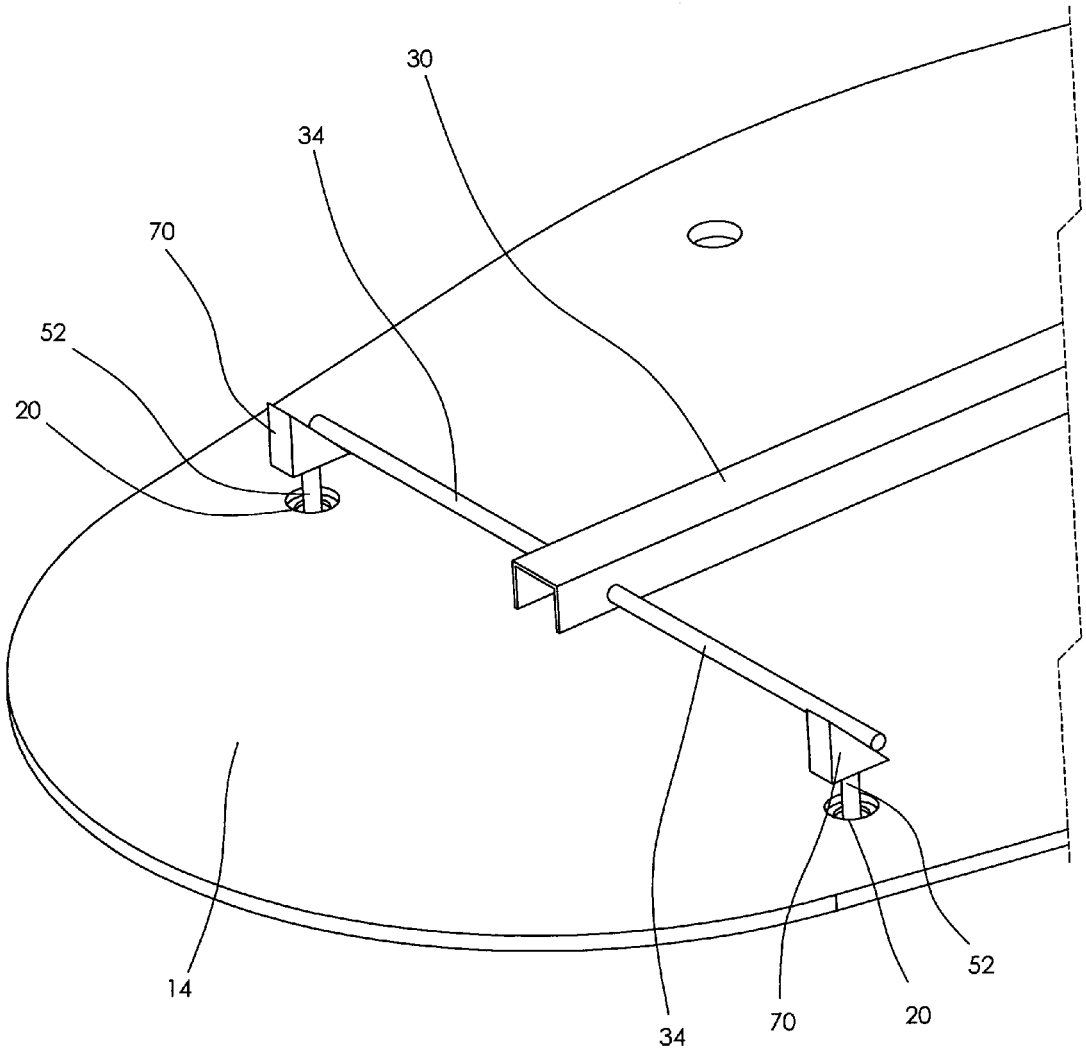
FIG. 7 is a perspective view of the sole of the footwear article of FIG. 1 with the footwear article removed according to an alternative embodiment.

Turning now to FIG. 7, an alternative embodiment of the present invention is illustrated in which the spikes 52 may include a wedge 70 secured to the top portion 54 of the spikes. The spike may be secured within the spike aperture 20 by the use of a sleeve 50 as described above. In this optional embodiment, the rods 34 may be fixedly or pivotally secured to the elongate member 30. The elongate member will be slidably supported within the sole 14 of the shoe 10 such that it is permitted to move horizontally along the longitudinal direction 16 of the shoe but is restrained from vertical movement.

As the elongate member 30 and therefore the rods 34 are moved from a second to a first position as described above, bearing portions 72 of the rods will frictionally bear against and press down on the wedges 70. The wedges will thereby press the spikes in a downward direction thereby extending the spikes from the sole 14. Springs or other suitable means may also be incorporated between the spikes 52 and the sleeves 50 to urge the spikes into their retracted positions when the elongate member 30 is in its second position as described above.

Figure 8:
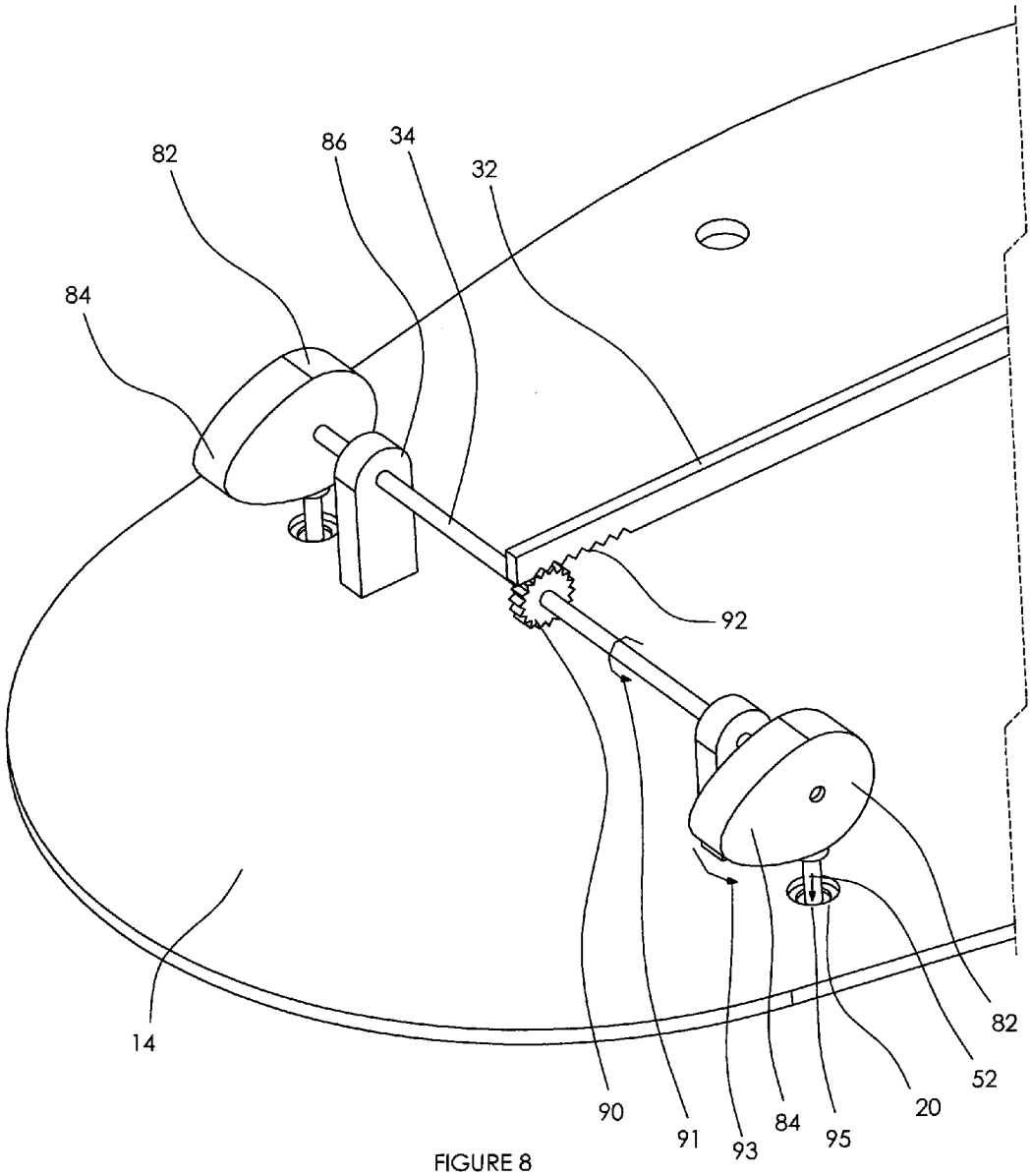
FIG. 8 is a perspective view of the sole of the footwear article of FIG. 1 with the footwear article removed according to an alternative embodiment.

Turning now to FIG. 8, an alternative embodiment of the present invention is illustrated in which the spikes 52 may include a cam follower 80 secured to the top portion 54 of the spikes. Each spike may be secured within it's spike aperture 20 by the use of a sleeve 50 as described above. In this optional embodiment, the rods 34 are pivotally supported by the sole 14 of the shoe 10 with rod supports 86 (only one being illustrated for clarity). The rods 34 include cams 82 corresponding to each spike 52 wherein each cam 82 includes a cam lobe 84 adapted to engage the cam followers 80 of the spikes 52. The rods 34 further include a pinion gear 90 or other suitable engagement for engagement with a corresponding rack gear 92 on the elongate member 30. The elongate member 30 will be slidably supported within the sole 14 of the shoe 10 such that it is permitted to move horizontally along the longitudinal direction 16 of the shoe but is restrained from vertical movement.

As the elongate member 30 is moved from a second to a first position as described above, the rack gear 92 engages with and rotates the pinion gear 90 and the rod 34 in a direction generally indicated at 91. As the rod is rotated within the rod supports 86, the cams 82 on the ends of the rod 34 are rotated in a direction generally indicated at 93 such that the cam lobes 84 engage upon the cam followers 80 of the spikes 52. The cam lobes 84 thereafter urge the cam followers 80 and the spikes 52 to an extended position as generally indicated at 95.

While specific embodiments of the invention have been described and illustrated, such embodiments should be considered illustrative of the invention only and not as limiting the invention as construed in accordance with the accompanying claims.

What is claimed is:

1. An apparatus for selectively extending spikes from the bottom of a footwear article, the footwear article having a sole having a longitudinal direction and a plurality of spike apertures, the apparatus comprising:

a plurality of spike assemblies, each of said plurality of spike assemblies having a selectively translatable spike, said spike being locatable within one of the spike apertures in the footwear article;

an elongate member mountable into the footwear article so as to be extendable substantially parallel to the longitudinal direction of the footwear article, said elongate member cooperating with said plurality of spike assemblies and moveable between first and second positions relative thereto so as to extend said spikes from said plurality of spike assemblies when in said first position and to retract said spikes within said plurality of spike assemblies when in said second position; and a cyclically alternating positioner for moving said elongate member between said first and second positions, said positioner having an actuating button, wherein depressing said actuating button a first time causes said positioner to move said elongate member to said first position and wherein depressing said actuating button a second time causes said positioner to move said elongate member to said second position, further comprising at least one rod extending transversely relative to said elongate member for transmitting said movement of said elongate member to said spike assemblies, wherein said at least one rod is supported within a slot in said elongate member, wherein said slot is orthogonal to said elongate member and said at least one rod, and wherein said each spike assembly further comprises a sleeve receivable within said apertures and slidably supporting said spike within said sleeve, a first link extending from a bottom portion of said sleeve to said at least one rod; and a second link extending from a top portion of said spike to said at least one rod.

2. The apparatus of claim 1 wherein said actuating button is a single button.

3. The apparatus of claim 1 wherein said actuating button comprises a plunger button acting against a return biasing spring.

4. The apparatus of claim 3 wherein said plunger button is cantilevered in a substantially horizontal plane.

5. The apparatus of claim 1 wherein said at least one rod is secured to said elongate member.

6. A shoe having an upper and a sole portion and a longitudinal direction, said sole having a plurality of spike apertures and a selectively operable spike extending assembly for extending a plurality of spikes from said sole through said plurality of spike apertures, said spike extending assembly comprising:

a plurality of spike assemblies, each of said plurality of spike assemblies cooperating with one of said spike apertures;

an elongate member extendable substantially parallel to said longitudinal member of said shoe and being moveable between first and second positions, said elongate member operable to extend said spikes from said shoe at said first position and to retract said spikes within said shoe at said second position;

a cyclically alternating positioner for extending said member between said first and second positions, said positioner having an actuating button;

wherein depressing said actuating button a first time causes said positioner to move said elongate member to said first position and wherein depressing said actuating button a second time causes said positioner to move said elongate member to said second position, wherein a portion of said sole covers said actuating button, and further comprising at least one rod extending transversely across said sole for transmitting said location of said elongate member to said spike assemblies, wherein said at least one rod is supported within a slot in said elongate member, wherein said slot is orthogonal to said elongate member and said at least one rod, and wherein said each spike assembly further comprises: a sleeve receivable within a corresponding said aperture, wherein said spike is slidably supported within said sleeve; a first linkage extending from a bottom portion of said sleeve to said at least one rod; and, a second linkage extending from a top portion of said spike to said at least one rod.

7. The shoe of claim 6 wherein said actuating button is contained within said sole.

8. The shoe of claim 6 wherein said actuating button projects from said sole.

9. The shoe of claim 6 wherein said at least one rod is secured to said elongate member.

* * * * *